US011549776B2

(12) United States Patent
Jacobson

(10) Patent No.: US 11,549,776 B2
(45) Date of Patent: Jan. 10, 2023

(54) ARMORER'S WRENCH

(71) Applicant: New Revo Brand Group, LLC, Plymouth, MN (US)

(72) Inventor: Ryan Jacobson, Minneapolis, MN (US)

(73) Assignee: NEW REVO BRAND GROUP, LLC, Plymouth, MN (US)

( * ) Notice: Subject to any disclaimer, the term of this patent is extended or adjusted under 35 U.S.C. 154(b) by 829 days.

(21) Appl. No.: 16/298,670

(22) Filed: Mar. 11, 2019

(65) Prior Publication Data

US 2019/0285377 A1 Sep. 19, 2019

Related U.S. Application Data

(60) Provisional application No. 62/643,528, filed on Mar. 15, 2018.

(51) Int. Cl.
*F41A 35/00* (2006.01)
*B25F 1/00* (2006.01)
(Continued)

(52) U.S. Cl.
CPC ..... *F41A 35/00* (2013.01); *B25B 13/48* (2013.01); *B25F 1/006* (2013.01); *B25F 1/02* (2013.01); *B25G 1/08* (2013.01); *F41A 21/48* (2013.01)

(58) Field of Classification Search
CPC ... B25F 1/006; B25F 1/02; B25F 1/00; B25G 1/08; B25G 1/005; B25G 1/085;
(Continued)

(56) References Cited

U.S. PATENT DOCUMENTS 2,716,367 A * 8/1955 Montgomery ..... B25B 13/04 81/124.3
4,268,927 A * 5/1981 Bridwell ..... B25D 5/00 30/367

(Continued)

FOREIGN PATENT DOCUMENTS

CN 104908012 A * 9/2015

OTHER PUBLICATIONS

"AR15 Armorer's Barrel Wrench—Gen 2, 2017, NcSTAR Patented Design: U.S. Pat. D. 703,502, p. 1" (Year: 2017).*

(Continued)

*Primary Examiner* — Robert J Scruggs
*Assistant Examiner* — Sidney D Hohl
(74) *Attorney, Agent, or Firm* — Grumbles Law PLLC; Brittany Haanan

(57) ABSTRACT

An armorer's wrench can include an elongate wrench body having an implement end structured and configured to define a plurality of wrench interfaces, and a handle end opposite the implement end being structured and configured to define a handle shape with a molded grip. The plurality of wrench interfaces can include at least one of a barrel nut wrench and a castle nut wrench, and the handle end can be devoid of wrench interfaces. The armorer's wrench can further include a plurality of hammer heads, hammer head storage, and a hammer head receiver. The handle end may be structured and configured to provide the hammer head storage, and the implement end may be structured and configured to provide the hammer head receiver. Each of the plurality of hammer heads may be structured and configured to securely and releasably attach to the hammer head receiver and to the handle end.

17 Claims, 6 Drawing Sheets

(51) Int. Cl.

| | |
|---|---|
| ***B25G 1/08*** | (2006.01) |
| ***B25B 13/48*** | (2006.01) |
| ***B25F 1/02*** | (2006.01) |
| *F41A 21/48* | (2006.01) |

(58) Field of Classification Search

CPC ..... B25B 13/00; B25B 13/48; B25B 23/00; B25D 1/02; B25D 1/14; B25D 1/00; F41A 35/00; F41A 11/00; F41A 21/00; F41A 21/48–487

USPC ..... D8/81, 31, 105, 107; 7/138, 146; 81/177.4, 25, 26; 42/108

See application file for complete search history.

(56) References Cited

U.S. PATENT DOCUMENTS

| | | | | |
|---|---|---|---|---|
| 4,291,736 | A | 9/1981 | Robertson | |
| 5,119,699 | A | 6/1992 | McBride | |
| 5,216,939 | A * | 6/1993 | Swenson | B25D 1/02 81/20 |
| 6,332,376 | B1 | 12/2001 | Hurley | |
| 6,536,308 | B1 * | 3/2003 | Thorne | B25D 1/02 81/22 |
| 6,655,236 | B1 | 12/2003 | Slack | |
| 7,013,516 | B1 | 3/2006 | Peters | |
| 7,334,502 | B1 | 2/2008 | Durkee | |
| D598,723 | S | 8/2009 | Cheng | |
| 7,818,843 | B2 | 10/2010 | Kinskey | |
| 8,091,266 | B2 | 1/2012 | Huang | |
| D666,883 | S * | 9/2012 | Howard | F41A 35/00 D8/19 |
| 8,479,404 | B1 | 7/2013 | Samson | |
| D703,502 | S | 4/2014 | Cheng | |
| D725,451 | S | 3/2015 | Mayberry | |
| 2005/0229322 | A1 * | 10/2005 | Chiu | B25F 1/00 7/138 |
| 2006/0075572 | A1 * | 4/2006 | Young | B25F 1/006 7/138 |
| 2012/0110745 | A1 | 5/2012 | Hanlon | |
| 2012/0291595 | A1 | 11/2012 | Hemesath | |
| 2013/0047483 | A1 | 2/2013 | Horne | |
| 2013/0192005 | A1 | 8/2013 | Christenson | |
| 2015/0290780 | A1 | 10/2015 | Bennett | |
| 2016/0221132 | A1 | 8/2016 | Wong | |
| 2016/0354909 | A1 * | 12/2016 | Weinberger | B26B 11/00 |
| 2017/0234087 | A1 * | 8/2017 | Gaska | E21B 15/00 175/85 |

OTHER PUBLICATIONS

"DPMS Multi-Tool AR-15 Steel." Retrieved from MidwayUSA.com.

"Micro-Adjustable Body Hammer With Interchangeable Heads SE." Retrieved from chainbin.com. Retrieved on Jun. 16, 2017.

"7 pc Dead Blow Interchangeable Fiberglass Handle Hammer Set." Retreived from Snap-on, Inc. website. Retrieved on Jun. 14, 2017.

"AR Armorer's Tool." Retrieved from tapco.com.

"Brownells—AR-15/M16 Combination Wrench." Retrieved from brownells.com. Retrieved on May 30, 2017.

* cited by examiner

ARMORER'S WRENCH

CROSS-REFERENCE TO RELATED APPLICATION

This application claims the benefit of U.S. Provisional Application Ser. No. 62/643,528 filed on Mar. 15, 2018, titled ARMORER'S WRENCH.

FIELD OF THE INVENTION

This disclosure relates to firearm maintenance aids, and more particularly, relates to multi-function wrenches for firearm maintenance.

BACKGROUND OF THE INVENTION

Assembly, disassembly, and other maintenance tasks on modern firearms can benefit from or require a variety of specific tools suitable for particular tasks. Maintenance for a rifle such as an AR-15 can involve multiple specialized wenches. There is a need to conveniently provide multiple tools to armorers working on such firearms to simplify their toolboxes and workflows.

SUMMARY OF THE INVENTION

This disclosure relates to firearm maintenance aids, and more particularly, relates to multi-function wrenches for firearm maintenance. In an illustrative but non-limiting example, the disclosure provides an armorer's wrench that can include an elongate wrench body. The elongate wrench body can include an implement end structured and can be configured to define a plurality of wrench interfaces, and a handle end opposite the implement end being structured and configured to define a handle shape with a molded grip. The plurality of wrench interfaces can include at least one of a barrel nut wrench and a castle nut wrench, and the handle end can be devoid of wrench interfaces.

In some examples, the armorer's wrench can include a plurality of hammer heads, hammer head storage, and a hammer head receiver. In some cases, the handle end may be structured and configured to provide the hammer head storage, and the implement end may be structured and configured to provide the hammer head receiver. In some cases, each of the plurality of hammer heads may be structured and configured to securely and releasably attach to the hammer head receiver of the implement end and to the handle end.

In some examples, each of the plurality of hammer heads can include a hammer face and a stud, the hammer head receiver can include a hammer stud receptacle structured and configured to receive one of the studs of one of the plurality of hammer heads, and the handle end can include at least one handle stud receptacle structured and configured to receive one of the studs of one of the plurality of hammer heads. Further, the handle end may include a plurality of handle stud receptacles equal in quantity to the plurality of hammer heads, the at least one handle stud receptacle may be located on a side of the handle substantially perpendicular to a hammering direction, and/or the studs of the plurality of hammer heads may be releasably securable to the hammer stud receptacles and the at least one handle receptacle via a threaded mechanism.

In some examples, the wrench can provide storage for the plurality of hammer heads without extra components beyond the wrench body and the plurality of hammer heads. And in some cases, the wrench can provide storage for the plurality of hammer heads without a storage compartment.

In some examples, the plurality of wrench interfaces can further include at least one of a ¾-inch wrench and a ⅝-inch wrench. Further, the at least one of the ¾-inch wrench and the ⅝-inch wrench may share an aperture with one of the barrel nut wrench and the castle nut wrench. In some cases, the one or more wrench interfaces can include both the ¾-inch wrench and the ⅝-inch wrench, and the ¾-inch wrench and the ⅝-inch wrench can share an aperture with one of the barrel nut wrench and the castle nut wrench.

In some examples, the implement end of armorer's wrench may be structured and configured to define a torque receiver.

In another illustrative but non-limiting example, the disclosure provides an armorer's wrench that can include a plurality of hammer heads and a wrench body. The wrench body can include a handle, a plurality of storage receptacles structured and configured to receive one of the plurality of hammer heads, a hammer head receiver structured and configured to receive any one of the plurality of hammer heads such that the any one of the plurality of hammer heads can be positioned for hammering when the handle is grasped by a user, and at least one wrench interface, wherein the handle may be devoid of the at least one wrench interface.

In some examples, each of the plurality of hammer heads can include a hammer face and a stud, the hammer head receiver can include a hammer stud receptacle structured and configured to receive one of the studs of one of the plurality of hammer heads, the plurality of storage receptacles may be located on the handle, and each of the plurality of storage receptacles can include a handle stud receptacle structured and configured to receive one of the studs of one of the plurality of hammer heads. In some cases, one or more of the handle stud receptacles plus the hammer stud receptacle may be equal or greater in quantity to the plurality of hammer heads.

In some examples, the armorer's wrench can include a tool implement that is not a hammer or a wrench interface. For example, the tool implement may be a torque receiver. In some cases, the wrench body can include two or more wrench interfaces.

In another illustrative but non-limiting example, the disclosure provides an armorer's wrench that can include a plurality of hammer heads that each include a hammer face and a stud, and a wrench body. The wrench body can include an implement end and a handle end. The implement end can be structured and configured to define a barrel nut wrench, a castle nut wrench, a ¾-inch wrench, a ⅝-inch wrench, a torque receiver, and a hammer head receiver with a hammer stud receptacle. The handle end can be structured and configured to define a handle, the handle being structured with one or more handle stud receptacles. The hammer stud receptacle and the one or more handle stud receptacles can be structured and configured to receive any of the studs of any of the plurality of hammer heads and to releasably secure any of the studs of any of the plurality of hammer heads (for example, via a threaded mechanism). Further, each of the ¾-inch wrench and the ⅝-inch wrench may share an aperture with one of the barrel nut wrench and the castle nut wrench.

The above summary is not intended to describe each and every example or every implementation of the disclosure. The Description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 3:
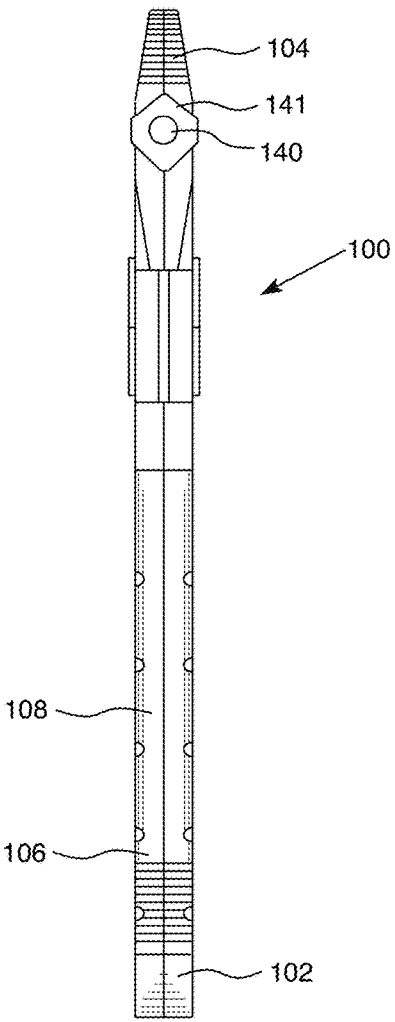
FIG. 3 is a schematic front elevation view of the wrench of FIG. 1.

The present disclosure relates to firearm maintenance aids, and more particularly, relates to multi-function wrenches for firearm maintenance. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, and those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Figure 2:
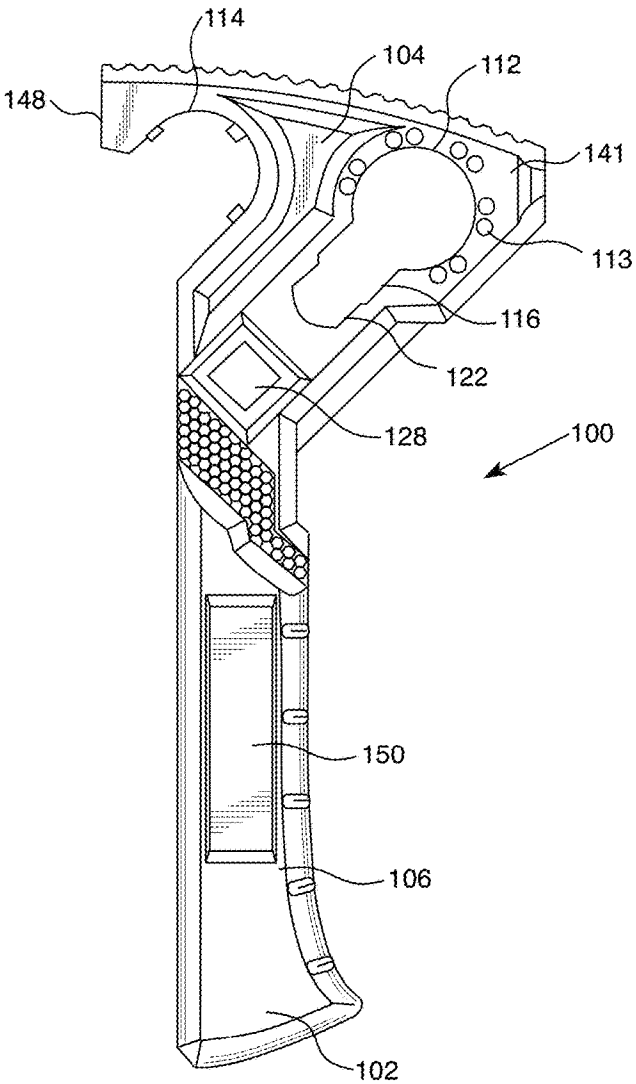
FIG. 2 is a schematic right-side elevation view of the wrench of FIG. 1.
Figure 1:
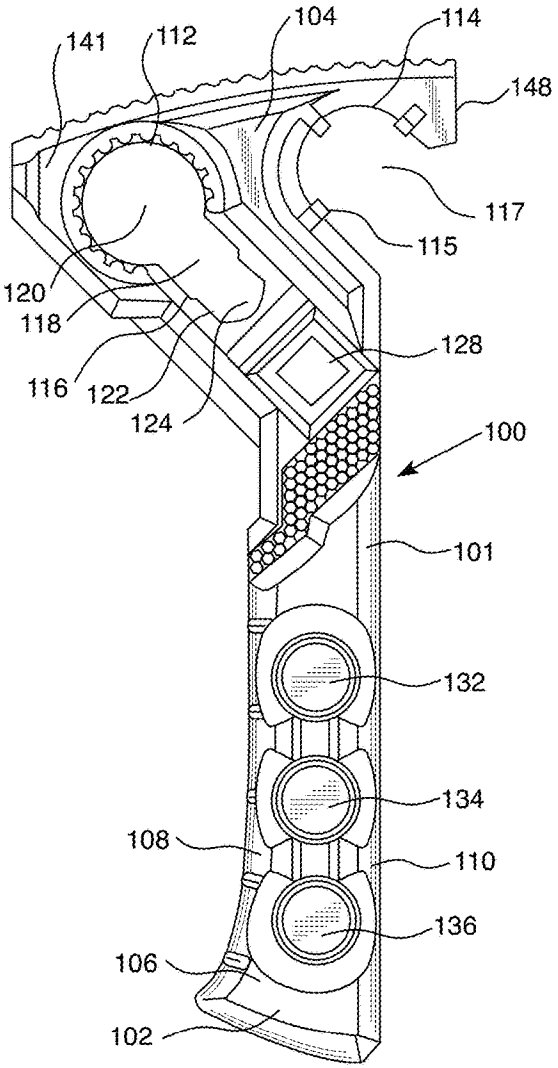
FIG. 1 is a schematic left-side elevation view of an illustrative example of an armorer's wrench of the present disclosure.

FIG. 1 is a schematic left-side elevation view, FIG. 2 is a schematic right-side elevation view, and FIG. 3 is a schematic front elevation view, of an armorer's wrench 100 of the present disclosure. Wrench 100 can be specifically directed toward maintenance for AR-15 type rifles, but this is not limiting and wrenches specifically directed toward maintenance for other specific rifles are possible, as are wrenches generally directed toward maintenance for rifles and/or other firearms. Wrench 100 can include a wrench body 101 constructed of any suitable material or materials. In some embodiments, wrench body 101 can be constructed of hardened stainless steel. In some embodiments, wrench body 101 can be of a unitary construction, having been forged, milled, or otherwise formed as a single piece of material. In some embodiments, and as illustrated in the Figures, wrench body 101 can be elongate such that one dimension is substantially longer than the other.

Wrench 100 can include a handle end 102 and an implement end 104. Handle end 102 and implement end 104 can be on opposite ends of an elongate wrench body 101. In one example of elongate wrench body 101, the length of wrench body from handle end 102 to implement end 104 may be substantially longer than the width of wrench body so as to provide additional torque to particular hardware elements of a firearm when wrench 100 is in use. At handle end 102, wrench 100 can include an ergonomic handle 106, which can include an injection-molded ergonomic grip. Ergonomic handle 106 can have a curved front side 108 and a flat back side 110. When gripped, fingers of a user may wrap around the curved front side 108 and the flat back side 110 may rest against the user's palm. However, this handle configuration is not limiting, and other handle configurations with differently-shaped sides are possible. Further, handle 106 need not necessarily be gripped as described above—for example, wrench 100 can be held by the user such that front side 108 rests against the user's palm and the flat back side 110 is wrapped around by the user's fingers.

Nonetheless, ergonomic handle 106 can intuitively invite a user's grip in a particular orientation. This intuitive particular orientation can be with the user's fingers wrapped around the curved front side 108, with the user's thumb closer to the implement end 104 than the butt of the handle end 102. The handle 106 at handle end 102 can vary in thickness, as illustrated in FIGS. 1 and 2, being narrower at the side nearer the implement end 104 and wider at the opposite side. The butt of the handle end 102, in the vicinity of reference numerals 102 and associated lead lines of FIGS. 1-3, can be flared larger than other portions of the handle, as illustrated in FIGS. 1 and 2, to ergonomically promote grip.

In some embodiments, ergonomic handle 106 can be the only handle that wrench 100 has, in that it may not be ergonomically natural or intuitive to grip wrench 100 by any other portion of the wrench.

Implement end 104 of wrench 100 can include multiple implements, interfaces, and/or devices for providing firearm maintenance, modification, and construction functions. With regard to nomenclature, in the present disclosure "wrench" may be used to refer to a tool unit such as wrench 100, and it can also be used to refer to an implement, interface, and/or device structured to interact with a particular hardware element of a firearm. It is expected that these different uses of the term "wrench" will be easily distinguished by persons having ordinary skill in the art of tools.

In some embodiments, wrenches of the present disclosure only include wrench implements at their implement ends. In other embodiments, wrenches of the present disclosure only include hammer implements at their implement ends. In yet other embodiments, wrenches of the present disclosure include wrench implements, hammer implements, and/or additional tool implements that are not wrench or hammer implements.

One such device at implement end 104 of wrench 100 can be a barrel nut wrench 112, which can be structured and configured to apply torque to a barrel nut of an AR-15. Barrel nut wrench 112 can be a two-sided barrel nut wrench.

Figure 4:
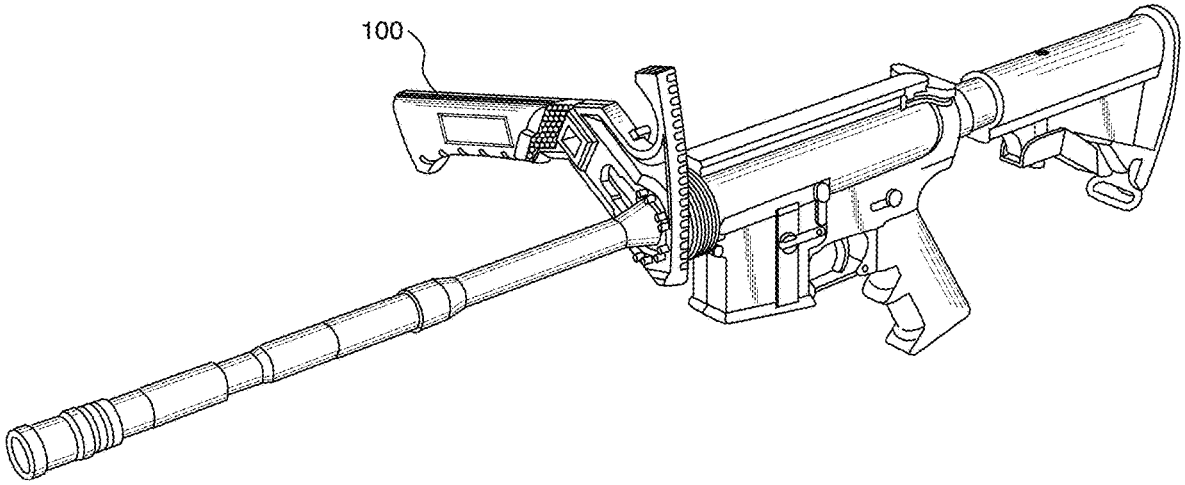
FIG. 4 is a schematic perspective view of the wrench of FIG. 1 engaged with a barrel nut of an AR-15.
Figure 5:
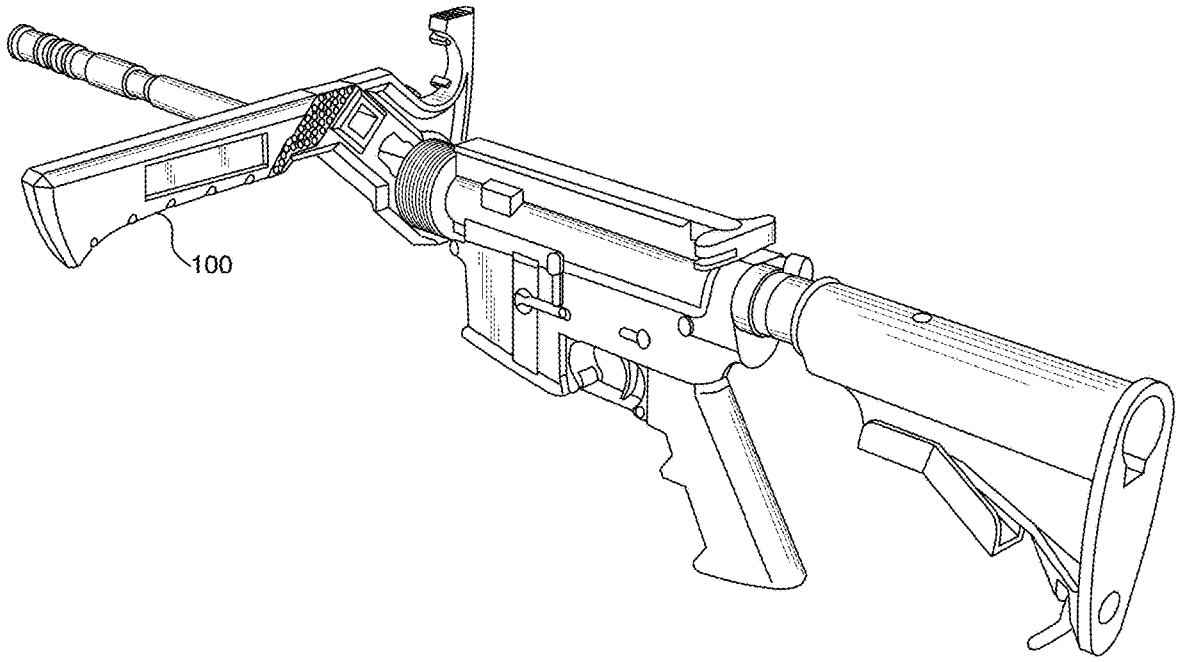
FIG. 5 is a schematic perspective view of the wrench of FIG. 1 engaged with a barrel nut of an AR-15.

A left side of barrel nut wrench 112 on the left side of wrench 100, visible in FIG. 1, can be structured and configured such that it can substantially surround a majority of the perimeter of a barrel nut when it is engaged with the barrel nut. A right side of barrel nut wrench 112 on the right side of wrench 100, visible in FIG. 2, can be structured and configured with a plurality of prongs 113 that can extend outwardly from the right side of the wrench, such that the right side may be able to readily engage with a recessed barrel nut that may not be readily engageable with the left side of the barrel nut wrench. FIGS. 4 and 5 are schematic perspective views of a wrench 100 engaged with a barrel nut (not visible) of an AR-15. More specifically, FIG. 4 illustrates a mil spec barrel nut wrench engaged with the firearm, and FIG. 5 illustrates a free-float barrel nut wrench engaged with the firearm.

Figure 6:
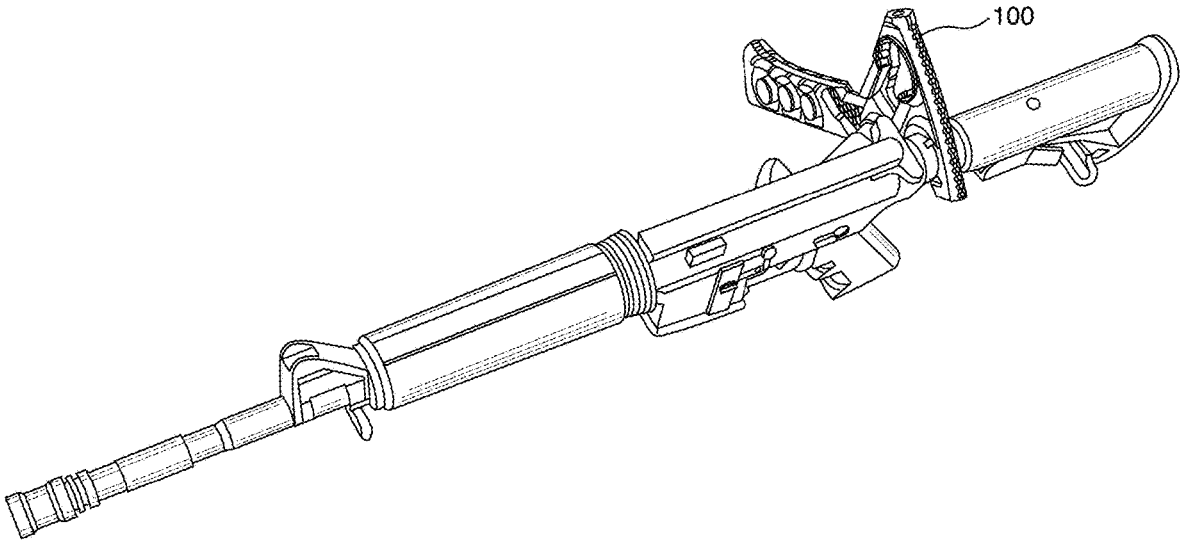
FIG. 6 is a schematic perspective view of the wrench of FIG. 1 engaged with a castle nut of an AR-15.

Another device at implement end 104 of wrench 100 can be a castle nut wrench 114, which can be structured and configured to apply torque to a castle nut of an AR-15. Castle nut wrench 114 can be a two-sided castle nut wrench. A right side of castle nut wrench 114 on the right side of wrench 100, visible in FIG. 2, can be structured and configured such that it can substantially surround a majority of the perimeter of a castle nut when it is engaged with the castle nut. A left side of castle nut wrench 114 on the left side of wrench 100, visible in FIG. 1, can be structured and configured with a plurality of prongs 115 that can extend outwardly from the left side of the wrench, such that the left side may be able to readily engage with a recessed castle nut that may not be readily engageable with the right side of the castle nut wrench. FIG. 6 is a schematic perspective view of a wrench 100 engaged with a castle nut of an AR-15. Note that the open end 117 of castle nut wrench 114 can facilitate engagement of wrench 100 with a castle nut despite the presence of larger-diameter or thicker rifle components aft of the castle nut.

Figure 7:
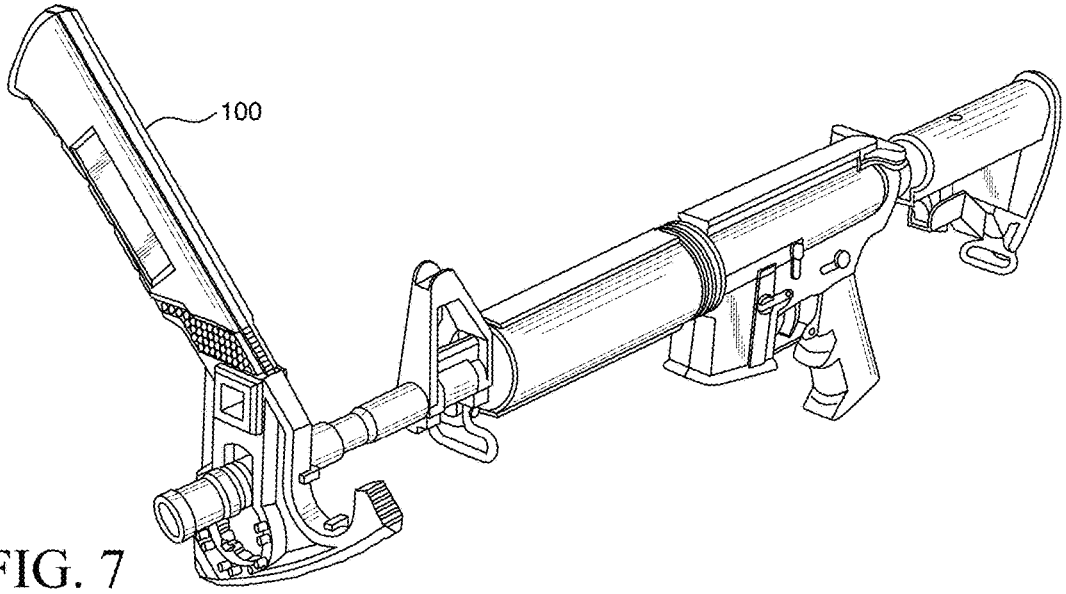
FIG. 7 is a schematic perspective view of the wrench of FIG. 1 engaged with a muzzle device of an AR-15.

In some embodiments, either or both of barrel nut wrench 112 and castle nut wrench 114 can be integrated with other implements. As illustrated in the Figures, barrel nut wrench 112 can be integrated with a ¾-inch wrench 116, which can surround a ¾-inch wrench aperture 118 that can be contiguous with a barrel nut wrench aperture 120. The ¾-inch wrench 116 can be structured and configured to be suitable for tightening or loosening accessories such as a muzzle brake and/or a flash hider. FIG. 7 is a schematic perspective view of a wrench 100 engaged with a muzzle device for an AR-15 via ¾-inch wrench 116.

Figure 8:
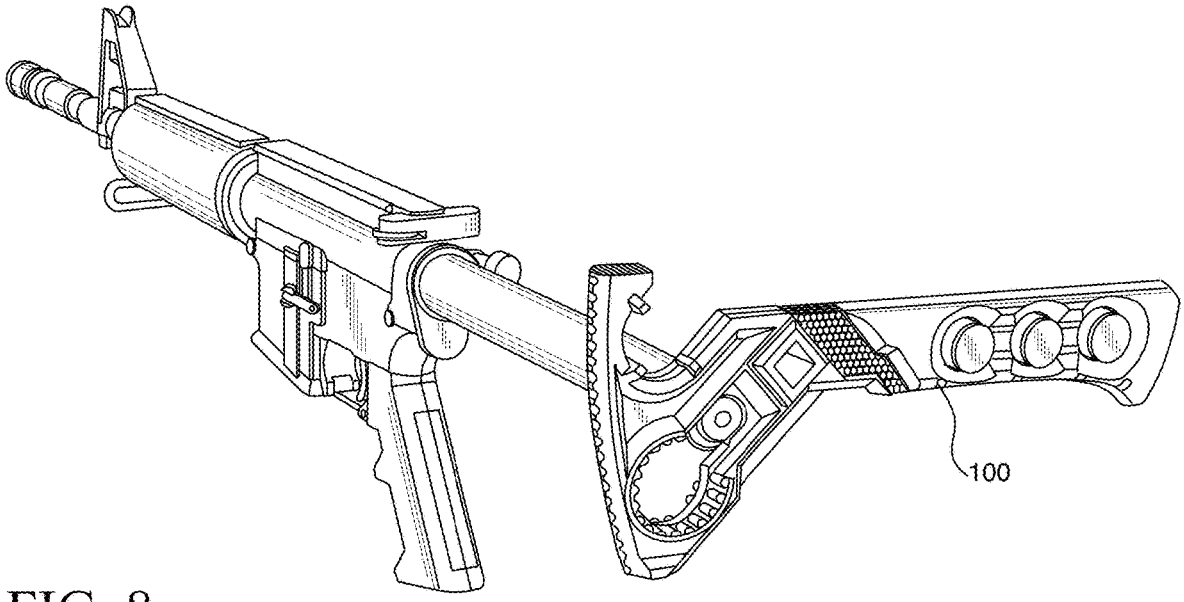
FIG. 8 is a schematic perspective view of the wrench of FIG. 1 engaged with a fixed stock receiver extension for an AR-15.

Wrench 100 can also include a ⅝-inch wrench 122, which can surround a ⅝-inch wrench aperture 124. As illustrated in the Figures, the ⅝-inch wrench 122 can be integrated with the ¾-inch wrench 116 and barrel nut wrench 112, and ⅝-inch wrench aperture 124 can be contiguous with ¾-inch wrench aperture 118 and barrel nut wrench aperture 120. However, such an integration configuration is not limiting, and other configurations are possible. In some embodiments, for example, only one of a ¾-inch wrench and a ⅝-inch wrench is integrated with a barrel nut wrench. In some embodiments, one or more other wrenches can be integrated with a castle nut wrench. FIG. 8 is a schematic perspective view of a wrench 100 engaged with a fixed stock receiver extension for an AR-15 via ⅝-inch wrench 122.

Figure 9:
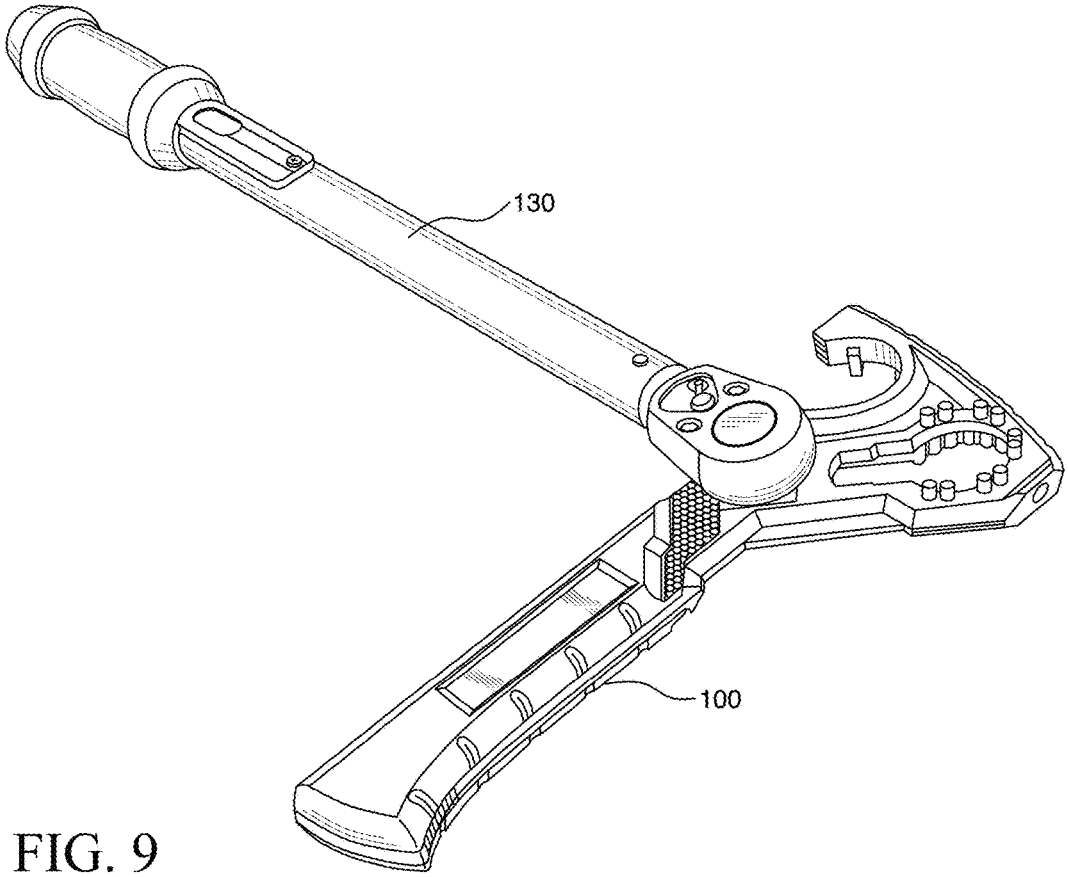
FIG. 9 is a schematic perspective view of a torque wrench engaged with a torque receiver of the wrench of FIG. 1.

For some operations, it may be desirable or necessary to tighten a device or fastener to a known torque value. Wrench 100 can be configured with a torque receiver 128 (for example, a ½-inch torque receiver) structured and configured to receive a driver of a torque wrench (for example, a ½-inch driver) such that the torque wrench can be used to apply torque to wrench 100 when applying torque via any of wrenches 112, 114, 116, or 122. FIG. 9 is a schematic perspective view of a torque wrench 130 engaged with torque receiver 128 (not visible).

Further, to help a user determine desired torque values for a specific application, torque values may be visible on handle 106. More specifically, label surface 150 on a side of wrench 100, such as a right side as visible in FIG. 2, can be structured and configured to have specific torque values visible to the user. However, other information may alternatively be provided on label surface 150. These torque values or other information may be added to the label surface 150 via engraving, laser cutting, or they may be printed on an adhesive that is added thereto. Examples of torque values that can be illustrated on label surface 150 may include: 30-80 ft/lb for a barrel nut, 40 ft/lb max for a castle nut, and 30 ft/lb for a muzzle brake.

Further tools can be integrated with wrench 100. In some embodiments, wrench 100 can function as a hammer with one or more hammer heads, although in some other embodiments, the present disclosure contemplates armorer's wrenches without hammer heads. As illustrated in the Figures, wrench 100 can include up to three interchangeable hammer heads 132, 134, 136 that can be stored on its handle 106 via hammer head storage.

Figure 10:
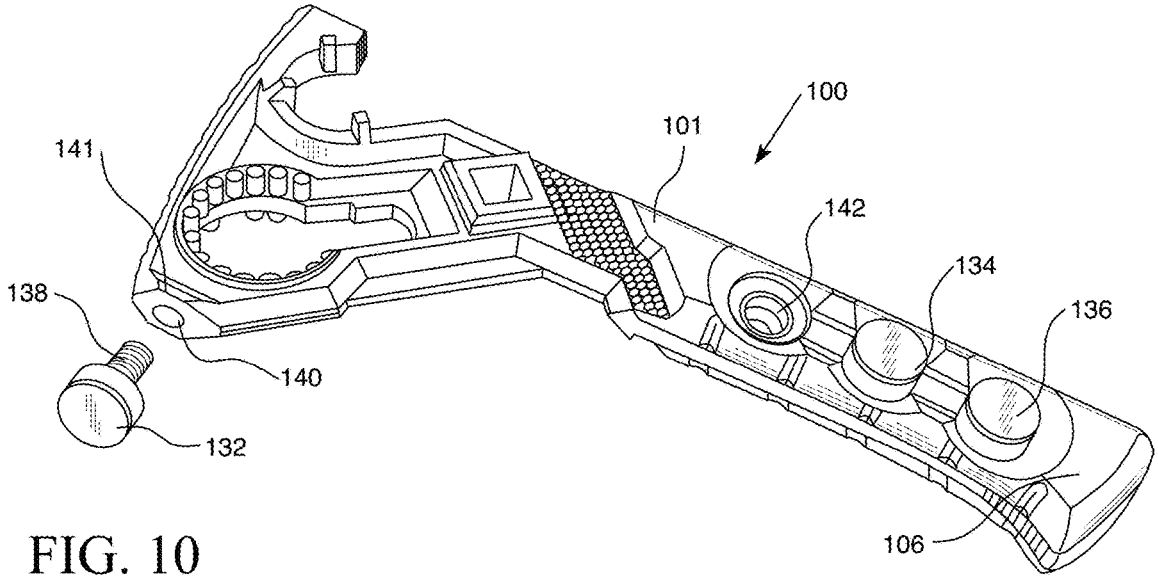
FIG. 10 is a schematic perspective illustration that shows the wrench of FIG. 1 with a first version of a detached hammer head.

FIG. 10 is a schematic perspective illustration that shows wrench 100 with hammer head 132 that has been removed from hammer head storage on handle 106 of the wrench, while hammer heads 134 and 136 remain in storage on the handle. In FIG. 10, hammer head 132 is shown just separated from wrench body 101. Hammer head 132 can include a stud 138 that can be received by hammer stud receptacle 140 of hammer head receiver 141. When stud 138 is received by or engaged with hammer stud receptacle 140 of hammer head receiver 141, hammer head 132 can be appropriately placed for hammering use when the wrench is grasped by handle 106. Stud 138 can also be received by a storage receptacle such as, but not limited to, one of handle stud receptacles 142 for storage of hammer head 132. As illustrated in FIG. 10, hammer heads 134 and 136 are in storage on handle 106 via their own studs 138 and handle stud receptacles 142 (studs 138 and receptacles 142 for hammer heads 134, 136 are not visible in FIG. 10, but are similar in function and appearance to stud 138 and receptacle 142 for hammer head 132).

In various other Figures of the present disclosure, all three hammer heads 132, 134, 136 are stored on handle 106 via studs 138 and handle stud receptacles 142. Each stud 138 can be securely and releasably retained by hammer stud receptacle 140 and handle stud receptacles 142 via a threaded mechanism, thus enabling the hammer heads 132, 134, 136 to securely and releasably attach to the hammer head receiver 141 and handle 106. Therefore, each stud 138 can be threaded and can screw into stud receptacles 140, 142, which may be female threaded holes.

Other mechanisms for releasably securing studs to receptacles are possible, such as (but not limited to) mechanisms relying upon friction or interference fit, a detent mechanism such as a spring-loaded ball and corresponding recess, or a magnet mechanism whereby the hammer heads 132, 134, 136 and/or the stud receptacles 140, 142 could be magnetized and, if only one of the features is magnetized, the non-magnetized feature could be configured to mate with the magnet (for example, it could be made of a ferromagnetic metal that is attracted to the magnetized feature).

Figure 11:
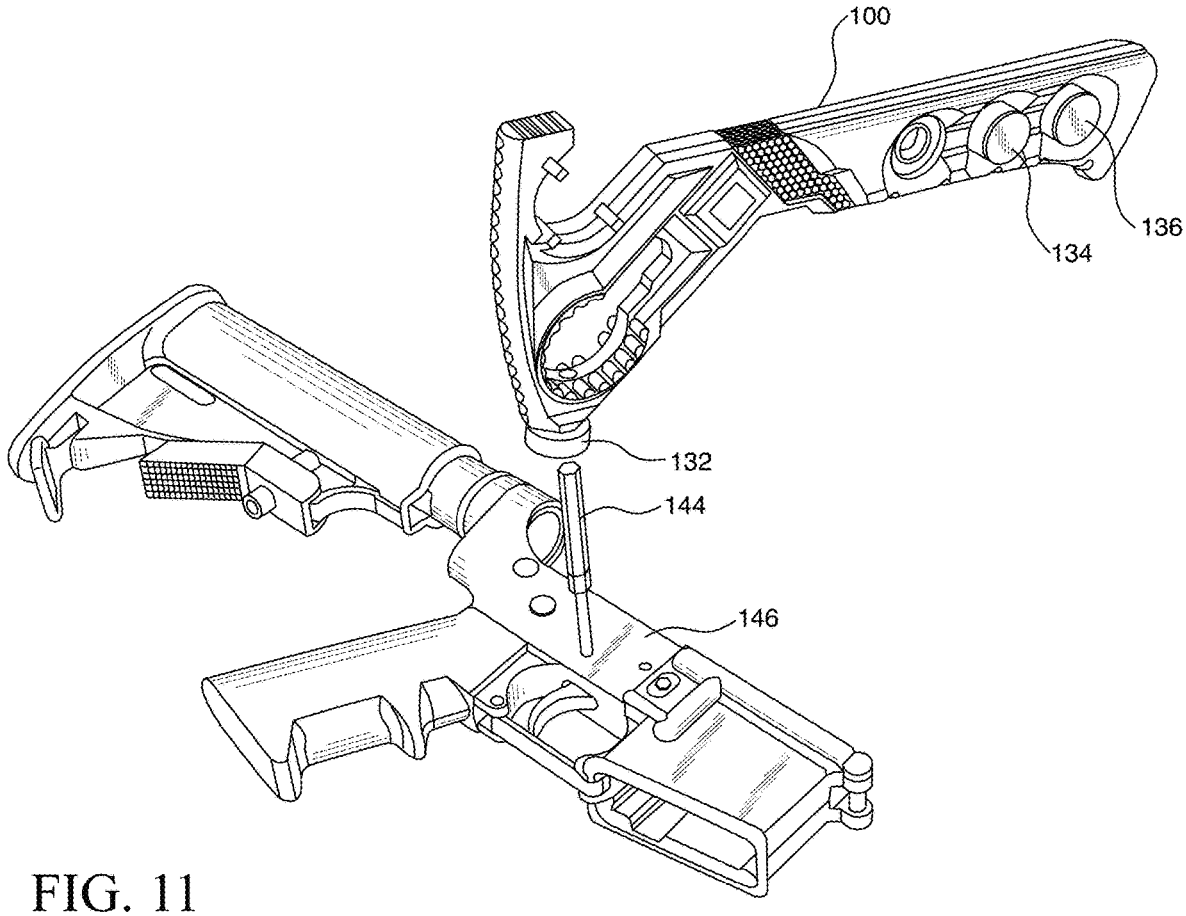
FIG. 11 is a schematic perspective illustration showing the wrench of FIG. 1 positioned for use as a hammer relative to a punch and lower receiver of an AR-15.

FIG. 11 is a schematic perspective illustration showing wrench 100 positioned for use as a hammer relative to a punch 144 and a lower receiver 146 of an AR-15.

Each hammer head 132, 134, 136 can include a hammer face of a different hammer head material for different hammering needs and applications. In some cases, one or more hammer heads 132, 134, 136 can be made of the same material as stud 138, but they can also be made of separate materials. Hammer head and stud materials can include brass, polymers (for example, nylon), rubber, steel, and any other suitable material.

Figure 12:
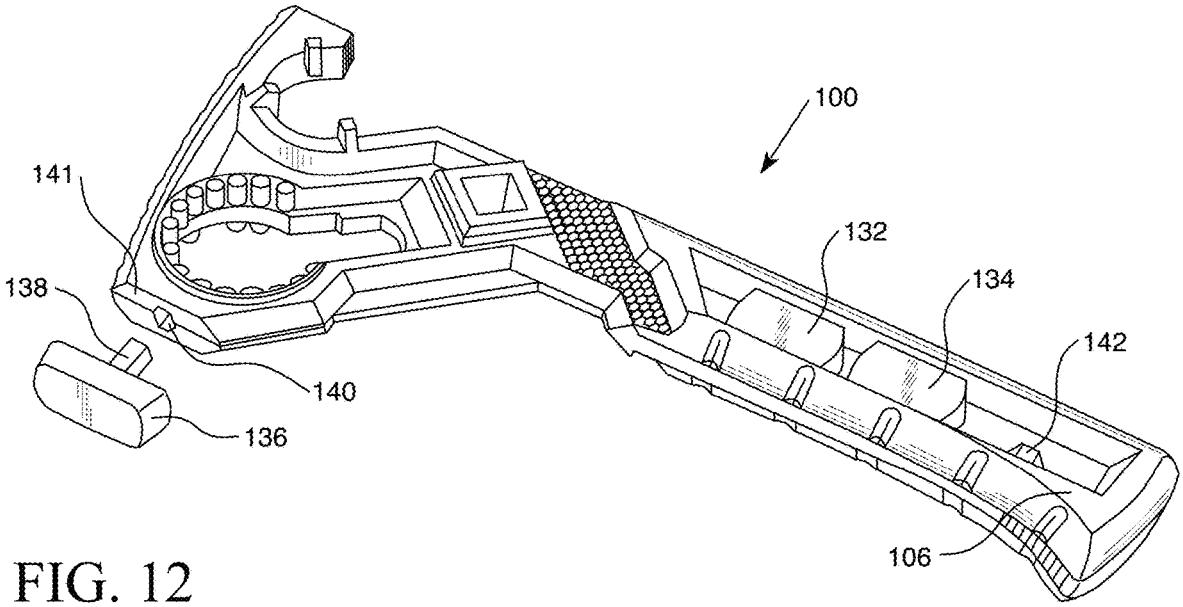
FIG. 12 is a schematic perspective illustration that shows an armorer's wrench of the present disclosure with a second version of a detached hammer head.

In some embodiments, and as illustrated in FIGS. 1 and 10-11, one or more of hammer heads 132, 134, 136 can have a face that is circular, but this is not limiting, and the face can be non-circular, as illustrated in FIG. 12. Studs 138 and stud receptacles 140, 142 can be circular, as illustrated in FIG. 10. Alternatively, studs 138 and stud receptacles 140, 142 can be non-circular (for example, hexagonal, as illustrated in FIG. 12) such that a particular hammer head orientation or orientations can be constrained.

In addition to hammer heads 132, 134, 136, one or more surfaces of wrench body 101 itself can be used as hammer heads. For example, hammer head receiver 141, without one of hammer heads 132, 134, 136 attached, and wrench back face 148 can both be used as a hammer head, and either or both can be hardened stainless steel hammer heads (when wrench body 101 is constructed from hardened stainless steel). Therefore, in one embodiment, hammer head receiver 141 can have interchangeable hammer heads 132, 134, 136 and wrench back face 148 can be a permanent steel (or other material) hammer head.

The innovative structure and configuration of wrench 100 advantageously provides multiple wrenches 112, 114, 116, 122, and multiple hammer heads with integral storage for the interchangeable hammer heads 132, 134, 136 on the handle 106 of the wrench. Wrench 100 conveniently provides storage for hammer heads 132, 134, 136 without requiring or involving a storage compartment or separate storage unit, or any extra components or parts beyond wrench body 101 and the hammer heads themselves. Storage of interchangeable hammer heads 132, 134, 136 on the handle 106 of wrench 100 also allows a user instant visual verification of the presence (or lack thereof) of the hammer heads with the wrench.

The present disclosure contemplates that an interchangeable hammer head configuration with handle-based hammer head storage can be practiced with tools other than the particular example of wrench 100 illustrated in the Figures. It could be practiced, for example, with a wrench having only a single wrench interface, and/or with a tool having a tool implement other than a wrench interface (and that is not a hammer). It could be practiced with a tool that is primarily or solely a hammer. Furthermore, storage and storage receptacles for hammer heads can be provided on such a tool in locations other than on the handle. And storage for hammer heads can be provided on such a tool in areas other than a storage compartment. However, storage of hammer heads on the handle may be advantageous compared with alternative locations. Storage of hammer heads on the handle may be more secure than alternative arrangements, for reasons including (but not limited to) the presence of a hand gripping the handle, and the magnitudes and directions of accelerations experienced at the handle during use, as compared with other locations on the tool.

Wrench 100 exhibits other advantages over competitive armorer's wrenches. Many competitive armorer's wrenches include various wrench implements at widely varying positions along the lengths of the wrenches, such that the location where a user grips the competitive wrenches can vary considerably depending upon which implement the user wishes to use. Furthermore, many such competitive wrenches lack an ergonomic handle, and in fact, the user is often forced to grasp the wrench un-ergonomically at the location of another implement. In contrast, wrench 100 has a single ergonomic handle 106 for use with all wrenches 112, 114, 116, 122 and for hammering. This design also provides a similar magnitude of lever arm for all wrenches 112, 114, 116, 122.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. An armorer's wrench, comprising:

an elongate wrench body, including:

an implement end, the implement end comprising a plurality of wrench interfaces; and a handle end opposite the implement end, the handle end comprising a handle shape with a molded grip; and at least one hammer head, wherein:

the plurality of wrench interfaces include a barrel nut wrench and a castle nut wrench;

the handle end is devoid of wrench interfaces;

the castle nut wrench has an open end;

the barrel nut wrench is completely encompassed within the wrench body;

the implement end comprises a hammer head receiver;

the castle nut wrench is positioned on the implement end and is opposite the hammer head receiver; and the barrel nut wrench is radially positioned between the at least one hammer head and the castle nut wrench with respect to a longitudinal axis of the armorer's wrench.

2. The armorer's wrench of claim 1, wherein the at least one hammer heads is structured and configured to securely and releasably attach to the hammer head receiver of the implement end and to the handle end.

3. The armorer's wrench of claim 2, wherein:

the at least one hammer head includes a flat hammer face and a stud;

the hammer head receiver includes a hammer stud receptacle structured and configured to receive the stud of the at least one hammer head; and the handle end includes at least one handle stud receptacle structured and configured to receive the stud of the at least one hammer head.

4. The armorer's wrench of claim 3, wherein the handle end includes a plurality of handle stud receptacles for receiving the at least one hammer head.

5. The armorer's wrench of claim 3, wherein:

the at least one handle stud receptacle is located on a side of the handle end substantially perpendicular to a hammering direction; and the hammer head receiver is in to alignment with the hammering direction.

6. The armorer's wrench of claim 3, wherein the stud of the at least one hammer heads is releasably securable to the hammer stud receptacle and the at least one handle receptacle via a threaded mechanism.

7. The armorer's wrench of claim 1, wherein the wrench provides external access on the handle to storage for the at least one hammer head.

8. The armorer's wrench of claim 1, wherein the at least one hammer head has a flat hammer face and a stud with a smaller diameter than a diameter of the hammer face.

9. The armorer's wrench of claim 1, wherein the plurality of wrench interfaces further include at least one of a ¾-inch wrench and a ⅝-inch wrench.

10. The armorer's wrench of claim 9, wherein the at least one of the ¾-inch wrench and the ⅝-inch wrench shares an aperture with one of the barrel nut wrench and the castle nut wrench.

11. The armorer's wrench of claim 9, wherein the plurality of wrench interfaces includes both the ¾-inch wrench and the ⅝-inch wrench, further wherein both the ¾-inch wrench and the ⅝-inch wrench share an aperture with one of the barrel nut wrench and the castle nut wrench.

12. The armorer's wrench of claim 1, wherein the implement end is structured and configured to define a torque receiver.

13. An armorer's wrench, comprising:

a plurality of hammer heads; and a wrench body, the wrench body including:

a handle;

a plurality of storage receptacles, each storage receptacle being structured and configured to receive one of the plurality of hammer heads;

a hammer head receiver structured and configured to receive any one of the plurality of hammer heads such that the any one of the plurality of hammer heads is positioned for hammering when the handle is grasped by a user;

a first wrench interface having an open end; and a second wrench interface, wherein the handle is devoid of the first and second wrench interfaces;

wherein the first wrench interface is a castle nut wrench and is positioned opposite the hammer head receiver;

wherein the second wrench interface is a barrel nut wrench and is completely encompassed within the wrench body; and wherein the barrel nut wrench is radially positioned between the hammer head receiver and the castle nut wrench with respect to a longitudinal axis of the armorer's wrench.

14. The armorer's wrench of claim 13, wherein:

each of the plurality of hammer heads includes a hammer face and a stud;

the hammer head receiver includes a hammer stud receptacle structured and configured to receive one of the studs of one of the plurality of hammer heads;

the plurality of storage receptacles are located on the handle; and each of the plurality of storage receptacles includes a handle stud receptacle structured and configured to receive one of the studs of one of the plurality of hammer heads.

15. The armorer's wrench of claim 14, wherein one or more handle stud receptacles plus the hammer stud receptacle are equal or greater in quantity to the plurality of hammer heads.

16. The armorer's wrench of claim 13, further comprising a tool implement that is not a hammer or a wrench interface.

17. The armorer's wrench of claim 16, wherein the tool implement is a torque receiver.

* * * * *